United States Patent [19]

Cosentino

[11] Patent Number: 4,571,910

[45] Date of Patent: Feb. 25, 1986

[54] APPARATUS FOR LAYING TILE

[76] Inventor: Edward Cosentino, 6075 Pelican Bay Blvd., Naples, Fla. 33940

[21] Appl. No.: 519,053

[22] Filed: Aug. 1, 1983

[51] Int. Cl.[4] ..... E04F 13/00; E04F 19/02

[52] U.S. Cl. ..... 52/391

[58] Field of Search ..... 52/391, 392, 586

[56] References Cited

U.S. PATENT DOCUMENTS

| | | | |
|---|---|---|---|
| 325,009 | 8/1885 | Peterson | 52/391 |
| 3,234,692 | 2/1966 | Bierlich | 52/392 |
| 4,170,859 | 10/1979 | Counihan | 52/391 X |

FOREIGN PATENT DOCUMENTS

| | | | |
|---|---|---|---|
| 1130144 | 5/1962 | Fed. Rep. of Germany | 52/391 |
| 639994 | 5/1962 | Italy | 52/586 |
| 1350754 | 4/1974 | United Kingdom | 52/391 |
| 1534501 | 12/1978 | United Kingdom | 52/586 |

*Primary Examiner*—J. Karl Bell

*Attorney, Agent, or Firm*—Merrill N. Johnson

[57] ABSTRACT

Apparatus which facilitates the laying of tiles with the front faces of all tiles lying in a common plane and with uniform spacing between adjacent tiles. The rear face of each tile has a plurality of similar elongated grooves and each groove runs perpendicularly from one of the edges of the tile. Each of these grooves is undercut in cross section and the distance between the bottom of each groove and the front face of each tile is exactly the same. A plurality of elongated spacer elements are provided, each having a portion for attachment into one of the grooves of a tile and a portion for supporting an adjacent tile. The attachment portion of each spacer element has a profile in cross section substantially the same as that of the grooves. The support portion of each spacer element has a profile in cross section substantially less than that of the groove and a maximum width less than that of the opening in the undercut part of the groove. The spacer element also has a rectangular flange projecting upwardly at 90° from the end of the support portion adjacent the attachment portion. Spacer elements are axially force-fitted into each of the grooves opening into adjacent edges of the tile constituting 50 percent of the edges of the tile with one face of the flange on the spacer element bearing against the edge of the tile.

10 Claims, 15 Drawing Figures

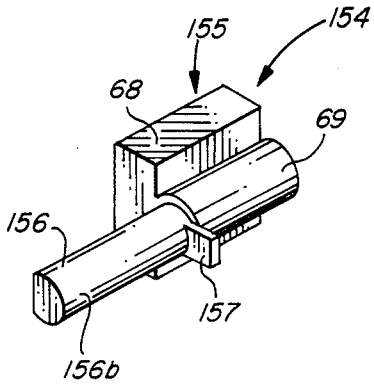
FIG. 10
FIG. 11
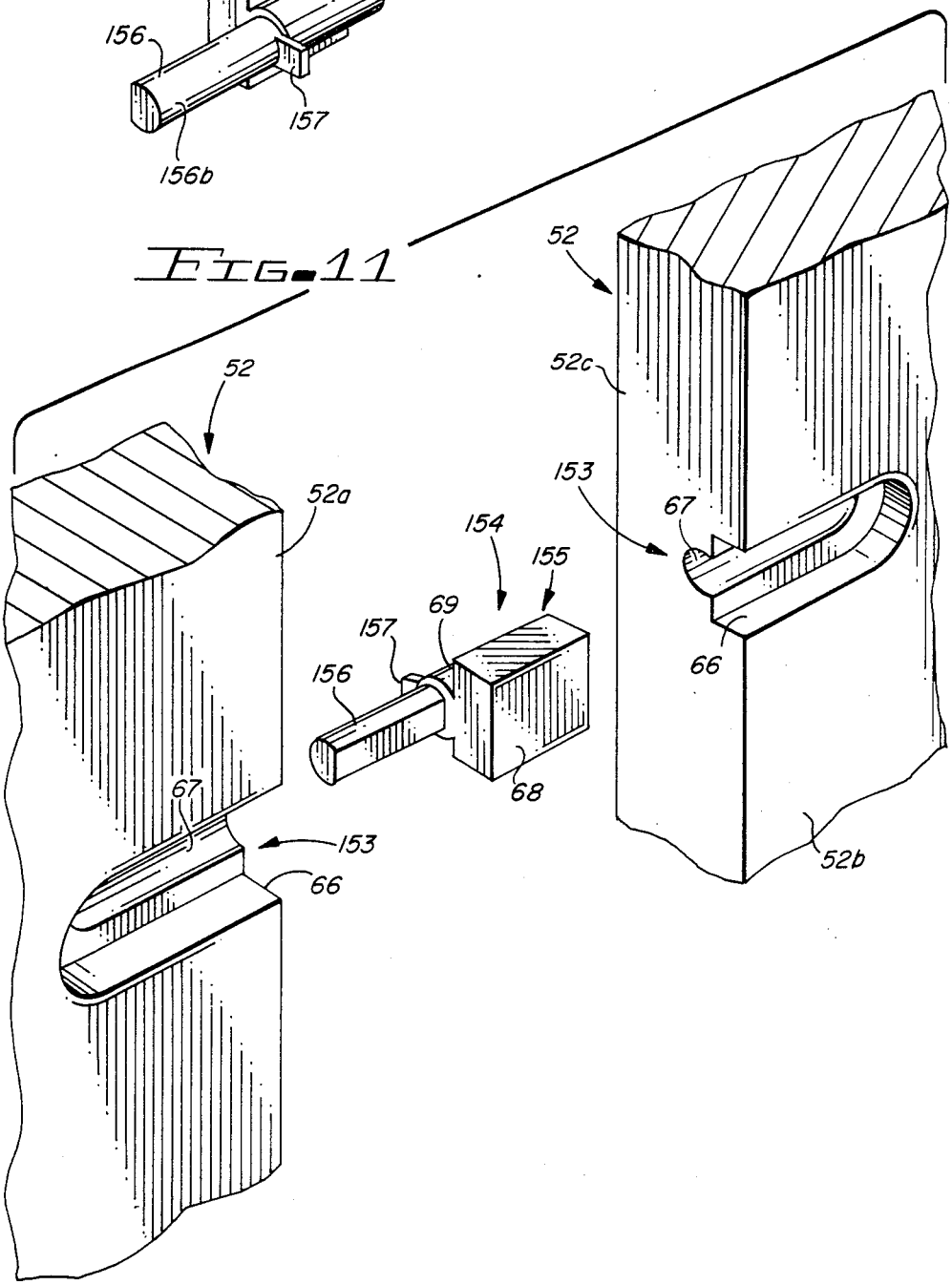

APPARATUS FOR LAYING TILE

BACKGROUND AND SUMMARY OF THE INVENTION

My invention provides improved apparatus which facilitates the laying of tile with the front faces of all tiles lying in a common plane and with uniform and accurately aligned spaces between adjoining tiles. The invention shown and described in this application is an improvement of the apparatus shown and described in the prior application of Edward Cosentino Ser. No. 422,649 filed Sept. 24, 1982.

The aforesaid application provided a unique method and apparatus which permits the laying of tile with exact alignment and spacing between adjacent tiles and insures that the front faces of all tiles will lie in a common plane using relatively unskilled labor in less time than previously required by skilled craftsmen. However, the particular form of apparatus used in accomplishing the desired result presented certain practical difficulties stemming mainly from the gluing of each spacer element to the rear face and adjoining side of the tiles.

The present improvement eliminates the necessity of gluing the spacer elements to the tiles. Instead the tiles are machined to provide a unique form of indentation and spacer elements having a tile attachment portion conforming to the form of the indentation are fitted into the tile's indentation.

Briefly stated, my invention provides improved apparatus for laying tiles onto a supporting surface comprising:

a tile having a front face intended to form part of a decorative surface and a rear face intended to be bonded to a bed of mortar applied to the supporting surface;

the rear face of the tile having a plurality of elongated grooves which extend for a short distance towards the middle of this face from each edge of the tile in a direction substantially perpendicular to each of these edges;

each of the grooves having at least one undercut part in cross section;

the distance between the bottom of each groove and the front face of the tile being exactly equal for all the grooves;

a plurality of elongated spacer elements, each including an attachment portion and a support portion which are aligned with each other and have lengths slightly less than the length of the grooves;

the attachment portion of each spacer element having a profile in cross section which is substantially the same as the cross sectional shape of the grooves;

the support portion of each spacer element having a profile in cross section which is substantially less than the cross sectional area of the groove and a maximum width which is less than the width of the opening into the undercut part;

the support portion also having a rectangular flange which projects at 90° from its end adjacent the attachment portion;

the attachment portions of respective spacer elements being axially force-fitted one into each of the grooves which open into adjacent edges of the tile constituting 50 percent of the edges of the polygonal tile, one face of the flange of each spacer element bearing against the edge of the tile adjacent thereto; and the support portion of each spacer element projecting from the tile and having a longitudinal support surface the distance of which from the front face of the tile is equal to the distance between this face and the bottom of each groove.

BRIEF DESCRIPTION OF THE DRAWINGS

FIG. 10 is a perspective view of a second embodiment of a spacer element according to the present invention.

FIG. 11 is a partial perspective view of two adjoining tiles and the spacer element before assembly.

DETAILED DESCRIPTION OF THE INVENTION

Figure 1:
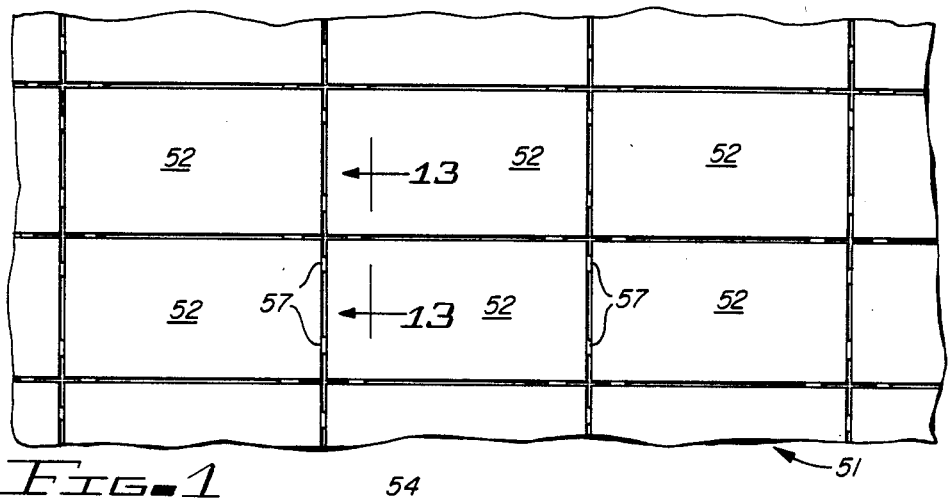
FIG. 1 is a partial plan view of a tiled surface obtained by use of my invention.
Figure 2:
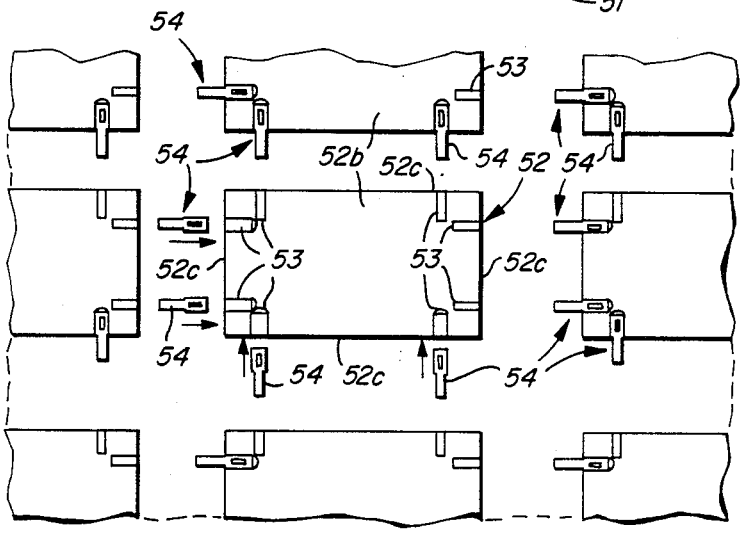
FIG. 2 is an exploded rear view of the tiles illustrated in FIG. 1.

FIGS. 1 and 2 of the drawings illustrate two views of an array 51 of rectangular marble tiles 52 laid in accordance with my invention upon a supporting surface with the interposition of a bed of wet cement to obtain a smooth even tiled surface with uniform spacing between adjacent tiles. Each tile 52, as best illustrated in FIG. 4, has a smoothly polished front face **52*a* and a rear face 52*b*** which is left rough to enhance its anchorage into the bed of cement.

As illustrated in FIG. 2, the rear face **52*b* of each tile 52 has two elongated grooves 53 in correspondence with each of the tile's edges 52*c*, each of the grooves 53 extending for a short distance towards the middle of the rear face 52*b* of the tile in a direction perpendicular to the tile's edge. Each groove 53 has a dovetail or undercut profile as best shown in FIG. 4. The distance X shown in FIG. 4 between the bottom surface of each groove and the front face 52*a*** of the tile is exactly the same for all tiles.

Figure 3:
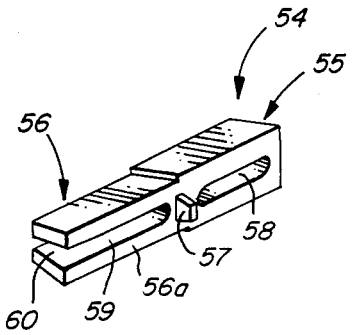
FIG. 3 is a perspective view of a spacer element according to an embodiment of my invention.
Figure 4:
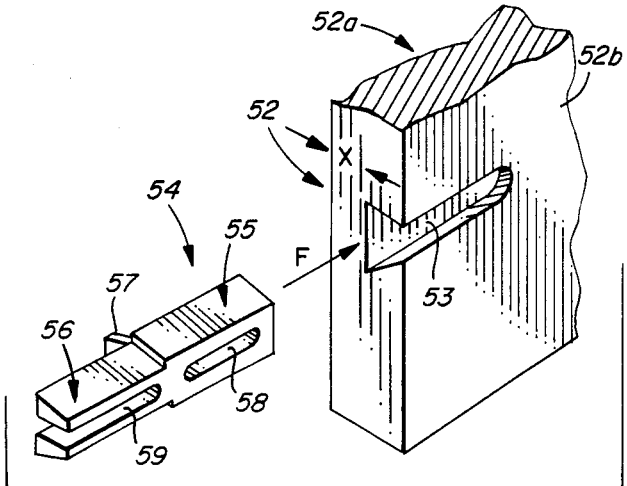
FIG. 4 is a partial perspective view of a spacer element being introduced into the groove of a tile.
Figure 5:
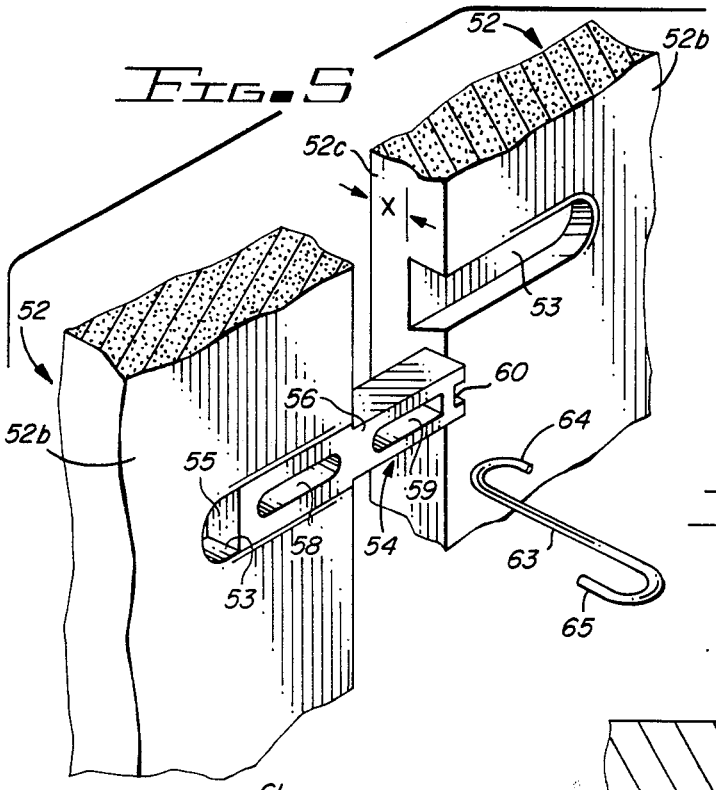
FIG. 5 is a view similar to FIG. 4 illustrating the spacer element inserted in the tile and with an adjacent tile being laid in place.
Figure 6:
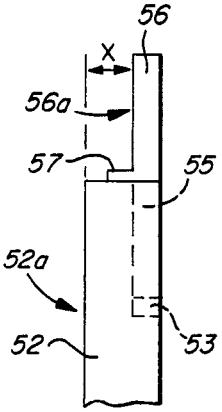
FIG. 6 is a partial plan view of FIG. 5.

My unique spacer elements 54, illustrated in detail in FIGS. 3 and 4, are force fitted into those grooves 53 which open into two adjacent sides of each rectangular tile 52. But when, for example, hexagonal tiles are used in accordance with my invention instead of rectangular tiles, spacer elements would be fitted into the grooves formed in three adjoining sides of each tile.

Each spacer element 54 is preferably made of a high strength plastic material, for example, nylon or polystyrene, moulded in the form of an elongated body having a tile attachment portion 55 and a support portion 56 which are aligned with each other. Each of the portions 55 and 56 of the spacer element 54 has a length slightly less than the length of the grooves 53.

The attachment portion 55 of each spacer element 54 has a profile of trapezoidal cross section corresponding to the dovetail or undercut cross section of the grooves 53 into which attachment portion 55 is intended to be inserted by axial forcing as indicated by the arrow F in FIG. 4. In order to achieve a force-fit of the portion 55 into the groove 53, the portion 55 is preferably wedge shaped.

Figure 8:
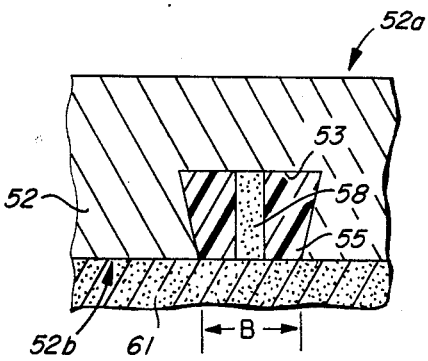
FIG. 8 is a section taken on the line 15—15 of FIG. 7.
Figure 9:
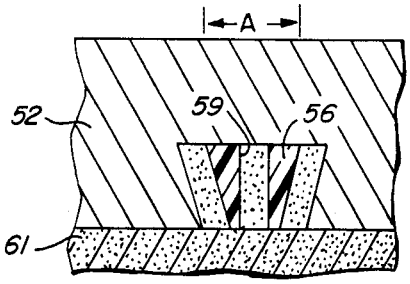
FIG. 9 is a section taken on the line 16—16 of FIG. 7.

The support portion 56 of each spacer element 54 has a profile having a trapezoidal shape similar to that of the portion 55, but narrower than portion 55 so that its cross sectional area is about 40 percent less than the cross sectional area of groove 53. As shown in FIGS. 8 and 9, the greatest width A of the profile of support portion 56 is less than the width B of the opening into the groove 53.

As seen from FIGS. 3, 4, 5 and 6, when the spacer element 54 is inserted in the groove 53 of a tile 52, the support portion 56 projects from the tile 52 and has a longitudinal support surface 56*a* the distance of which from the front face 52*a* of the tile 52 is equal to the distance X between the face 52*a* and the bottom of each groove 53. The support portion 56 has a rectangular flange 57 projecting at 90° from its end adjacent the attachment portion 55.

The attachment portions of each spacer element 54 has an elongated aperture 58 extending between its base faces, and the attachment portion 56 has a similar elongated aperture 59 between its base faces and a groove 60 bisecting its end face and continuing along surface 56*a* up to aperture 59. The groove 60, which has a width substantially equal to that of the aperture 59, extends across the end face of the portion 55 in a direction perpendicular to the base faces of the portion 55.

Figure 7:
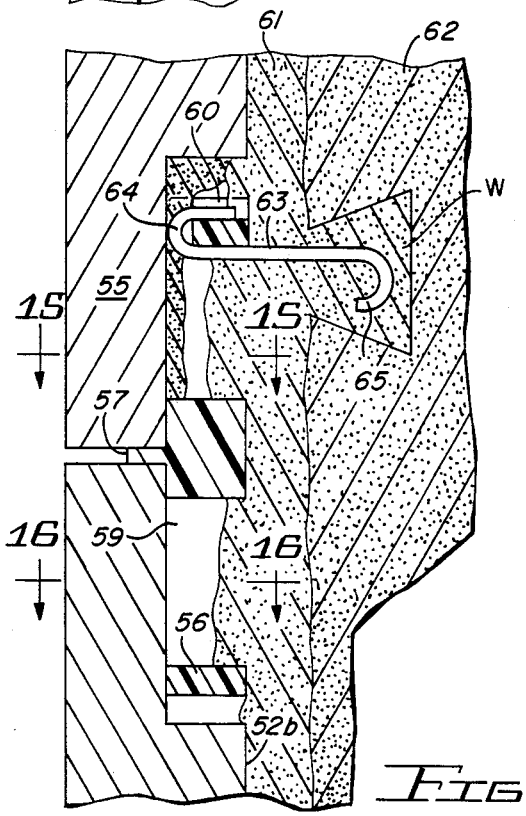
FIG. 7 illustrates two adjacent tiles in partial cross section after their application to a supporting surface.

In order to form the array 51 of tiles illustrated in FIG. 1, a bed of cement mortar 61 is applied to a support surface 62 as best shown in FIG. 7. A rectangular tile 52 having two spacer elements 54 force-fitted into the grooves 53 of each of two adjacent edges of the tile, as previously described, is then placed on the mortar bed and the tile is pressed lightly into the desired position.

A second tile 52 is then placed alongside the first tile so that two of the empty grooves 53 of the second tile bear on the support surfaces 56*a* of the support portions 56 of two spacer elements 54 which project from the first tile 52. As a result of this positioning of the second tile 52, its front face 52*a* will lie in the same plane as the front face of the first tile and its edge 52*c* will bear against the flanges 57 of the two spacers 54, whereby the second tile will be exactly parallel to the first tile and uniformly spaced from the adjacent edge 52*c* of the first tile. Successive tiles are then positioned in the same manner as described above to complete the array 51 which will thus be perfectly uniform.

In tiling a wall, as illustrated in FIG. 7, the aperture 59 and the groove 60 of the support portion 56 are used to connect a metal or plastic anchoring element or rod to the portion 56, the anchoring element having a straight portion 63 and two end portions 64 and 65 bent at 180° in opposite directions. One end of the anchoring element is introduced through the elongated aperture 59 and its bent portion 64 is housed in the groove 60. The other bent end 65 of the anchoring element is located in hole W formed in the support wall 62 and fixed in this hole by means of cement mortar 61.

Some materials such as granite used to make tiles, because of their physical properties, do not lend themselves to forming sharp edged dovetail or undercut grooves as shown in FIGS. 4 through 9. In FIGS. 10 to 14, a spacer element is illustrated for forming an array of granite tiles X using the same concept as illustrated in FIGS. 1 through 9.

In FIGS. 11 through 14, tile 52 is made of granite. Each groove 153 in tile 52 has, in cross section, a first part 66 of rectangular profile and a narrow bottom part 67 of circular profile with an extent of greater than 180° whereby it has a narrow opening and forms an undercut cavity 67.

Each spacer element 154 has an attachment portion 155 having a profile in cross section the same as that of the groove 153 and comprising a parallelepiped portion 68 and a cylindrical portion 69. The support portion 156 is provided with a rectangular flange 157 and has a profile in cross section which is substantially circular and similar to the profile of cavity 67 of the groove 153 but narrower in that its diameter C is less than the width D of the narrow opening of cavity 67.

Figure 12:
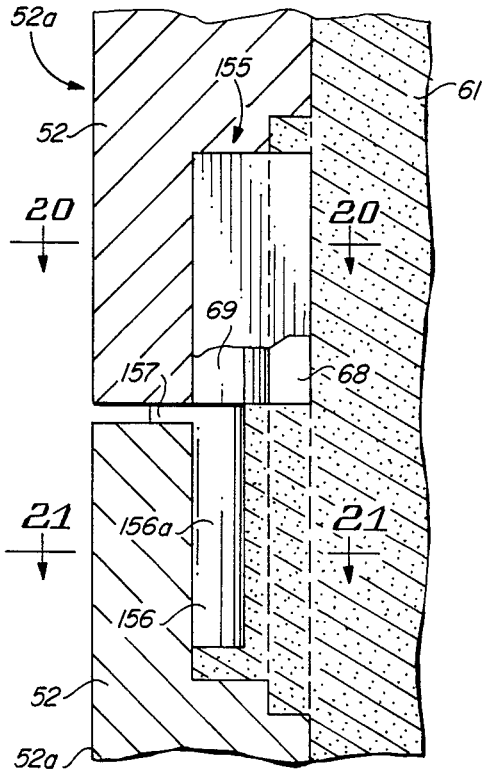
FIG. 12 is a section illustrating the two tiles of FIG. 11 after assembly on a supporting surface.
Figure 13:
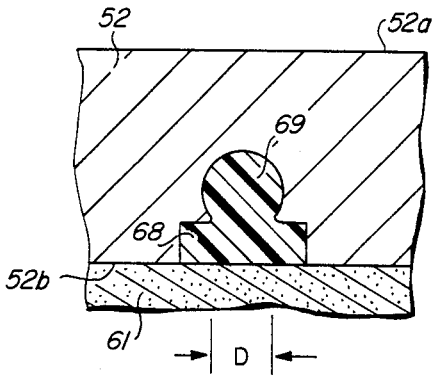
FIG. 13 is a cross sectional view taken on the line 20—20 of FIG. 12.
Figure 14:
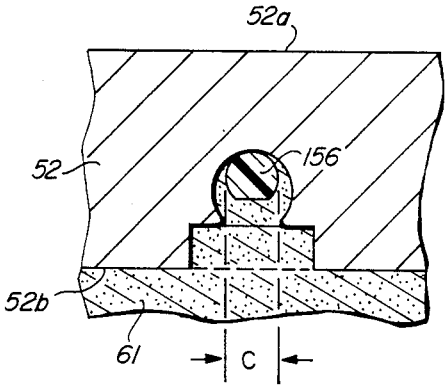
FIG. 14 is a cross sectional view taken on the line 21—21 of FIG. 12.

As best seen from FIG. 12, the bottom of support surface 156*a* of the support portion 156 engages the bottom of cavity 67 of groove 153 of a second tile lying adjacent a first tile in which the attachment portions 155 of the spacers 154 have been force-fitted. The bottom of surface 156 is located at the same distance from tile face 52*a* as the bottom surfaces of the grooves 67 of the first tile, whereby the coplanarity of the front faces 52*a* of the two tiles is again ensured in this case. Moreover, in this case, the flanges 157 of the spacers 154 again provide the correct parallel spacing between the adjacent sides 52*c* of the two adjacent tiles.

Figure 15:
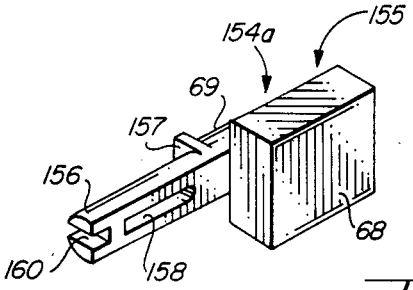
FIG. 15 is a perspective view of a variant of the spacer element illustrated in FIGS. 10 and 11.

FIG. 15 illustrates a spacer element 154 which differs from the element 154 illustrated in FIGS. 10 and 11 in that the support portion 156 has an aperture 158 and a groove 160 in its end face for allowing the connection of an anchoring element of the type labelled 63, 64, 65 in FIG. 7 to this portion 156.

I have shown and described two preferred embodiments of my invention. It will be apparent to those familiar with the art of laying tile that changes in and modifications of various elements of my invention can be made without departing from the scope and spirit of my invention. Accordingly, my invention is to be limited only by the following claims.

I claim:

1. Apparatus for laying tiles on a supporting surface comprising a tile having a decorative front face and a rear face intended to be bonded to a bed of mortar applied to the supporting surface, the rear face of the tile having a plurality of elongated grooves which extend towards the middle of the rear face from each of the edges in a direction substantially perpendicular to each of these edges, each of said grooves having at least one undercut part in cross section, the distance between the bottom of each groove and the front face of the tile being exactly equal for all the grooves, a plurality of elongated spacer elements each including an attachment portion and a support portion which are aligned with each other and have lengths slightly less than the length of the grooves, the attachment portion of each spacer element having a profile with a cross sectional shape substantially the same as the cross sectional shape of the grooves, the support portion of each spacer element having a profile with a cross sectional area substantially less than the cross sectional area of the undercut part of the groove and a maximum width which is less than the width of the opening into the undercut part of the groove, the support portion having a rectangular flange projecting at 90° from its end adjacent the attachment portion, the attachment portions of respective spacer elements being axially force-fitted one into each of the grooves which open into adjacent edges of the tile constituting 50 percent of the edges of the polygonal tile, one face of the flange of each spacer element bearing against the edge of the tile adjacent thereto, and the support portion of each spacer element projecting from the tile and having a longitudinal support surface the distance of which from the front face of the tile is equal to the distance between this face and the bottom of each groove.

2. Apparatus according to claim 1 characterised in that the cross sectional profile of the support portion of each spacer element is similar to the cross sectional profile of the undercut part of the groove.

3. Apparatus according to claim 1 characterised in that the rear face of the tile has two similar grooves at each of its edges.

4. Apparatus according to claim 1 characterised in that each groove has an essentially dovetail profile in cross section and the support portion of each spacer element has a trapezoidal dovetail profile in cross section, in which the larger face has a width less than the width of the narrowest part of the groove.

5. Apparatus according to claim 1 characterised in that each groove has, in cross section, a first part of rectangular profile and a narrow bottom part of circular profile with an extent greater than 180° whereby it has a narrow opening, and in that the support portion of each spacer element is constituted by a profiled section having, in cross section, a substantially circular profile with a diameter less than the width of the narrow opening in the tile.

6. Apparatus according to claim 3 characterised in that the support portion of each spacer element has an elongated aperture extending between its base faces and a groove in its end face, the groove extending perpendicular to the base faces and having a width substantially equal to that of the aperture.

7. Apparatus according to claim 6 characterised in that it further includes a rodlike anchoring element, having a straight portion and two end portions bent at 180° in opposite directions with respect to the straight portion, one end of this anchoring element being introduced through the said elongated aperture of the support portion of a spacer element and having its bent portion housed in the groove in the end face of the support portion.

8. Apparatus according to claim 3 characterised in that the attachment portion of each spacer element has an elongated aperture extending between its base faces.

9. Apparatus according to claim 1 characterised in that the attachment portion of each spacer element is wedge shaped.

10. Apparatus according to claim 1 characterised in that each spacer element is made of a moulded plastic material.

* * * * *